US009303400B2

(12) United States Patent
Maeers

(10) Patent No.: US 9,303,400 B2
(45) Date of Patent: Apr. 5, 2016

(54) CONSTRUCTION BLOCKS

(76) Inventor: Richard Maeers, Calgary (CA)

( * ) Notice: Subject to any disclaimer, the term of this patent is extended or adjusted under 35 U.S.C. 154(b) by 0 days.

(21) Appl. No.: 14/123,108

(22) PCT Filed: May 31, 2012

(86) PCT No.: PCT/CA2012/050359

§ 371 (c)(1),
(2), (4) Date: Nov. 28, 2013

(87) PCT Pub. No.: WO2012/162834

PCT Pub. Date: Dec. 6, 2012

(65) Prior Publication Data

US 2014/0090325 A1 Apr. 3, 2014

Related U.S. Application Data

(60) Provisional application No. 61/457,768, filed on May 30, 2011.

(51) Int. Cl.

| | |
|---|---|
| ***E04B 2/16*** | (2006.01) |
| ***E04C 1/00*** | (2006.01) |
| ***E04B 2/18*** | (2006.01) |
| *E04B 2/02* | (2006.01) |

(52) U.S. Cl.
CPC ... *E04B 2/16* (2013.01); *E04B 2/18* (2013.01); *E04C 1/00* (2013.01); *E04B 2002/0245* (2013.01)

(58) Field of Classification Search
CPC ..... E04B 2/16; E04B 2/18; E04B 2002/0245; E04C 1/00
USPC ..... 52/503, 504, 505, 582.1, 585.1, 596, 52/603, 604, 605, 606, 607, 747.12
See application file for complete search history.

(56) References Cited

U.S. PATENT DOCUMENTS

| | | | | | |
|---|---|---|---|---|---|
| 932,261 | A | * | 8/1909 | Flynn | E04B 1/161 405/132 |
| 2,141,397 | A | * | 12/1938 | Locke | 52/204.2 |
| 2,225,612 | A | * | 12/1940 | Allen | 52/586.2 |
| 2,392,551 | A | * | 1/1946 | Roe | 52/586.2 |
| 2,961,731 | A | * | 11/1960 | Buzzell et al. | 264/35 |
| 2,963,828 | A | * | 12/1960 | Belliveau | 52/564 |
| 3,170,267 | A | * | 2/1965 | Rosenfeld | 52/105 |
| 3,563,582 | A | * | 2/1971 | Shroyer et al. | 52/309.13 |

(Continued)

FOREIGN PATENT DOCUMENTS

| | | | | | |
|---|---|---|---|---|---|
| CL | WO 2014089718 | A1 | * | 6/2014 | A63H 33/10 |
| JP | 2010065453 | A | * | 3/2010 | |

OTHER PUBLICATIONS

Machine Translation of JP 2010065453 A prepared by JPO on Sep. 22, 2014 (16 pages).*

*Primary Examiner* — Rodney Mintz
(74) *Attorney, Agent, or Firm* — Richard D. Okimaw

(57) ABSTRACT

A kit for forming a wall comprises at least one building block having an exterior surface adapted to be closely stacked with a plurality of corresponding adjacent blocks and having at least one hollow in at least one surface thereof. A plurality of connecting ties each extending between first and second ends and having an enlarged portion located at at least one end thereof are utilized to connect and tie the building blocks together. The enlarged portions are adapted to be received within the hollows so as to span a pair of adjacent building blocks.

7 Claims, 8 Drawing Sheets

(56) References Cited

U.S. PATENT DOCUMENTS

| | | | | | |
|---|---|---|---|---|---|
| 3,640,039 | A * | 2/1972 | McKee et al. | 52/281 |
| 3,791,090 | A * | 2/1974 | Kniefel | 52/590.2 |
| 3,968,611 | A * | 7/1976 | de Munck | 52/396.02 |
| 4,228,628 | A * | 10/1980 | Schlomann | E04B 2/06 52/438 |
| 4,372,705 | A * | 2/1983 | Atkinson | E02B 3/14 404/40 |
| 4,391,077 | A * | 7/1983 | Giess | 52/748.11 |
| 4,454,699 | A * | 6/1984 | Strobl | 52/585.1 |
| 4,457,117 | A * | 7/1984 | Leiher et al. | 52/238.1 |
| 4,545,167 | A * | 10/1985 | Brock | 52/509 |
| 4,696,140 | A * | 9/1987 | Marshall | E04B 2/20 52/442 |
| 4,833,856 | A * | 5/1989 | Zwagerman | 52/592.1 |
| 5,365,714 | A | 11/1994 | Potvin | |
| 5,367,851 | A * | 11/1994 | Larson | 52/585.1 |
| 5,402,609 | A * | 4/1995 | Kelley, Jr. | 52/98 |
| D363,558 | S * | 10/1995 | McCoy | D25/113 |
| 5,673,530 | A * | 10/1997 | Bailey, II | 52/606 |
| 5,768,845 | A * | 6/1998 | Beaulieu et al. | 52/585.1 |
| 5,802,792 | A | 9/1998 | Fielding et al. | |
| 5,901,521 | A * | 5/1999 | Guy | 52/604 |
| 5,934,039 | A * | 8/1999 | Guy | 52/747.12 |
| 6,014,849 | A * | 1/2000 | Yonemura | 52/586.1 |
| 6,189,282 | B1 * | 2/2001 | VanderWerf | 52/582.1 |
| 6,431,792 | B1 * | 8/2002 | Barnes | 405/25 |
| 6,539,682 | B1 | 4/2003 | Ryder | |
| 6,739,797 | B1 * | 5/2004 | Schneider | B28B 7/0029 404/35 |
| 6,874,291 | B1 * | 4/2005 | Weber | 52/586.1 |
| 6,962,027 | B2 * | 11/2005 | Zawinsky | 52/585.1 |
| 6,996,945 | B2 * | 2/2006 | Doty | 52/585.1 |
| 7,152,383 | B1 * | 12/2006 | Wilkinson et al. | 52/581 |
| 7,191,571 | B2 * | 3/2007 | Schools et al. | 52/607 |
| 7,340,868 | B2 * | 3/2008 | Weber | 52/586.1 |
| 7,594,370 | B2 * | 9/2009 | Clarke | 52/586.1 |
| 8,122,668 | B2 * | 2/2012 | Fang | 52/568 |
| 8,266,862 | B2 * | 9/2012 | Huang | 52/585.1 |
| D688,816 | S * | 8/2013 | MacDonald | D25/114 |
| 8,667,750 | B2 * | 3/2014 | Speer | 52/223.5 |
| 8,850,683 | B2 * | 10/2014 | Haughey et al. | 29/428 |
| 8,931,223 | B2 * | 1/2015 | Speer | 52/223.7 |
| 2001/0046410 | A1 * | 11/2001 | Nakanishi et al. | 403/188 |
| 2003/0150185 | A1 * | 8/2003 | Godeke et al. | 52/576 |
| 2004/0000114 | A1 * | 1/2004 | Schools et al. | 52/505 |
| 2004/0112004 | A1 * | 6/2004 | Zawinsky | 52/749.1 |
| 2004/0226246 | A1 * | 11/2004 | Doty | 52/503 |
| 2006/0117697 | A1 * | 6/2006 | Adam | 52/596 |
| 2007/0175158 | A1 * | 8/2007 | Cope et al. | 52/585.1 |
| 2010/0018146 | A1 * | 1/2010 | Aube | E02D 29/0233 52/483.1 |
| 2011/0277414 | A1 * | 11/2011 | Huang | 52/586.1 |
| 2012/0233952 | A1 * | 9/2012 | Hammer | 52/588.1 |
| 2013/0036700 | A1 * | 2/2013 | Speer | 52/583.1 |
| 2013/0205705 | A1 * | 8/2013 | Bilka | 52/604 |
| 2013/0276401 | A1 * | 10/2013 | MacDonald | 52/606 |
| 2014/0130434 | A1 * | 5/2014 | Speer | 52/293.2 |
| 2015/0075106 | A1 * | 3/2015 | Vandenbempt | 52/596 |

* cited by examiner

CONSTRUCTION BLOCKS

CROSS REFERENCE TO RELATED APPLICATION

This application claims priority to U.S. Provisional Patent Application No. 61/457,768 filed May 31, 2011 entitled Construction Blocks.

BACKGROUND OF THE INVENTION

1. Field of Invention

The present invention relates to building construction in general and in particular to building elements made from wood, waste or non-viable wood and/or recycled materials and a method of constructing buildings employing the same.

2. Description of Related Art

Many types of building construction are presently known an used around the world. Many of these types of construction have adapted from the materials at hand or due to the environmental constraints that are placed upon the location. Disadvantageously, many conventional construction methods may not be as environmentally or cost efficient or be readily erectable.

One such method of building construction is known as timber frame construction utilizing large timbers as the main structural supports of the home also known as post and beam framing. Although this method provided a very strong and long lasting structure, large timbers became increasingly difficult and expensive to obtain. Additionally, the ease of construction and lower cost of framing houses with lighter pieces of milled lumber offered similar qualities for a significantly lower cost and were easier to produce in large quantities.

Another common conventional building forming method is to build walls from an array of vertical supporting columns called studs in a construction technique known as wood frame construction. These supports are placed rather close together making it easy to apply sheet materials (such as plywood or drywall) and strip materials (such as siding boards or lath for plaster) to the studs on the inside and outside of the framed structure. These building methods disadvantageously, consume substantial natural resources and in particular, consume natural resources in a manner which take a long time to replace, namely large, old growth trees.

Other non-wood construction methods have also been developed, however these methods have been difficult and time consuming to construct a building using these methods. The first challenge to conventional construction is the Structural Insulated Panel (SIP). SIPs are a modular and energy-efficient method of construction that uses large sheets of rigid foam insulating material (expanded polystyrene or EPS) sandwiched between sheets of board-stock such as plywood, oscillated strand-board (OSB) or some other type of suitable manufactured product. Sometimes the exterior siding material is also attached to the plywood at manufacture, and some manufacturers have chosen to pre-apply the interior finish wall material at this stage. The SIP system however, still requires a basic wood frame to create the structure for the building. The system also suffers from inflexibility and the need for pre-planning at the site, and does require expertise in its application.

A second alternative to conventional wood frame construction takes its design cue from the very entrenched practice of foundation forming or cribbing. Insulated Concrete Forms (ICFs) are hollow foam blocks or panels which are stacked in a prescribed shape or pattern to form the exterior walls of a building. They then reinforce the system by installing steel rebar, they then pour the concrete to fill the void and create a reinforced concrete wall sandwiched between two layers of rigid foam insulation.

Although ICFs do offer a multitude of benefits over conventional wood frame construction, this method still suffers a number of drawbacks. Notably, the entire building envelop requires a relatively high level of skills, tradesmen and equipment necessary to construct the foundation walls and floor of any wood frame structure. The cost involved in this form of construction also outweigh that of conventional framing, and increase the cost of the building proportionately. Constructing the ICF building also requires more time than does erecting a wood framed structure.

SUMMARY OF THE INVENTION

According to a first embodiment of the present invention there is disclosed an apparatus for forming a wall comprising a building block having an exterior surface adapted to be closely stacked with a plurality of corresponding adjacent blocks and having at least one hollow in a surface thereof. The hollow is adapted to receive an enlarged portion of a connecting tie therein. The connecting tie is adapted to span two adjacent building blocks.

According to a further embodiment of the present invention there is disclosed a kit for forming a wall comprising a building block having an exterior surface adapted to be closely stacked with a plurality of corresponding adjacent blocks and having at least one hollow in at least one surface thereof. The kit further comprises a plurality of connecting ties each extending between first and second ends and having an enlarged portion located at at least one end thereof. The enlarged portions are adapted to be received within the hollows so as to span a pair of adjacent building blocks.

The building blocks may have a substantially cuboid shape. The building blocks may have a pair of parallel spaced apart hollows. The hollows may be located in at least one of a top or bottom surface of the building blocks. The hollows may comprise bores extending through the building blocks. The bores may comprise parallel spaced apart bores. The bores may be located equidistance from each of an end surface and opposed side surfaces of the building blocks. The bores may be spaced apart by a distance equal to a width of the building blocks.

The connecting ties may include a pair of spaced apart enlarged portions. The connecting ties may include an elongate member extending between the enlarged portions. The enlarged portions may comprise pins. The pins may correspond in size and shape to bores extending through the building blocks.

The elongate members may be connected to a midpoint of the pins. The elongate members may include a frangible portion at a midpoint thereof. The building blocks may include a channel extending between the notches, the channel being sized and shaped to receive the elongate portion of a connecting tie spanning a pair of connected building blocks therein when the building block is laid thereover and spanning the pair of connected building blocks.

According to a further embodiment of the present invention there is disclosed a method for constructing a wall comprising locating a first building block on a surface, locating a second building block adjacent to the first building block and locating a first pin of an connecting tie within a first bore in the first building block and a second pin of the connecting tie within a second bore of the second building block so as to operable couple the first and second building blocks together. The method may further comprise locating a third building block on the connecting tie so as to receive the first and second pins within corresponding first and second bores of the third building block.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

The novel aspects of the wall construction system described herein generally relate to a building block 100 as it is utilized with this embodiment of the invention. The building blocks 100 are created by combining chipped and ground wood materials; combined with commonly available resins and binding agents, through known manufacturing processes of extrusion, co-extrusion, or the like. Extrusion results in a block of singular density, mass and material consistency. Co-extrusion results in a block with an extruded inner core and a co-extruded outer shell, resulting in a block of varying density, mass and material consistency. Co-extrusion provides the ability to vary the mass and mass density of the resulting block which may present some advantages over basic extrusion for some embodiments of the block system (reduced weight and decreased temperature conductivity). It will be appreciated that other methods of forming the present blocks may be utilized as well, such as, by way of non-limiting example, moulding, machining or the like.

Figure 1:
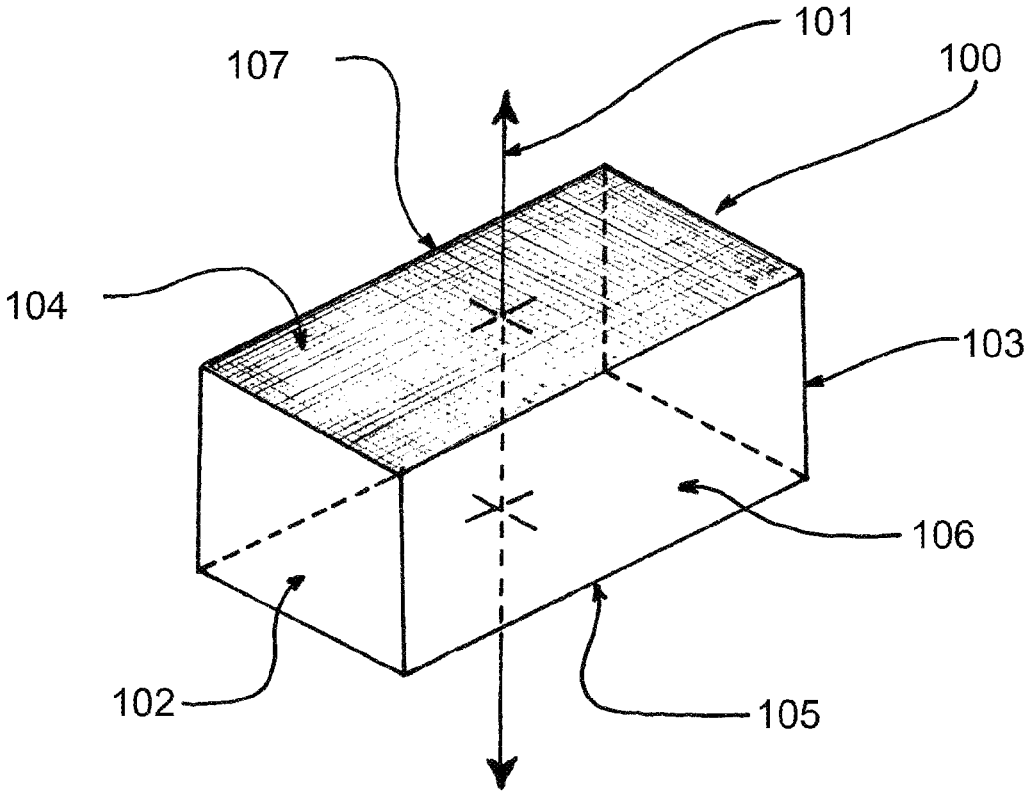
FIG. 1 is a top perspective view of an extrusion produced block for use in forming a building block according to a first embodiment of the present invention.

As shown in FIG. 1, the building block 100 may be manufactured along an extrusion axis 101. This axis represents the path along which material is combined and moves during the extrusion/co-extrusion process as are commonly known in the art. The building block 100 is severed or otherwise severed at opposing ends to form top and bottom surfaces, 104 and 105, respectively from a longer extruded member extending along the extrusion axis 101 by any known means. The top and bottom surfaces 104 105 are substantially perpendicular to the extrusion axis 101 and may be a planar and level surface. The building block is further defined by first and second sides, 106 and 107, respectively, and first and second ends 102 and 103, respectively. The first and second sides 106 and 107 are substantially parallel to each other and to the axis 101 and the first and second ends 102 and 103 are substantially parallel to each other and the axis such that the building block has a cuboid shape. It will be appreciated that when produced by extrusion, the sides 106 and 107 and ends 102 and 103 will all be undisturbed extruded surfaces. The resulting advantages of this fact will be discussed later in the description.

The height of the building blocks 100 is determined when cut, and selected as desired by a user for a particular application, such as, by way of non-limiting example, between 2 and 12 inches (51 and 305 mm). The length and width parameters of the blocks may also be varied at manufacture according to the needs of the user for a particular application, and may be manufactured to maintain a ratio therebetween. In particular, it has been found that selecting the length of the blocks between the first and second ends 102 and 103 to be twice as long as the width between first and second sides 106 an 107 of the block has been particularly useful. It will also be appreciated that other ratios may also be useful as well.

Figure 2:
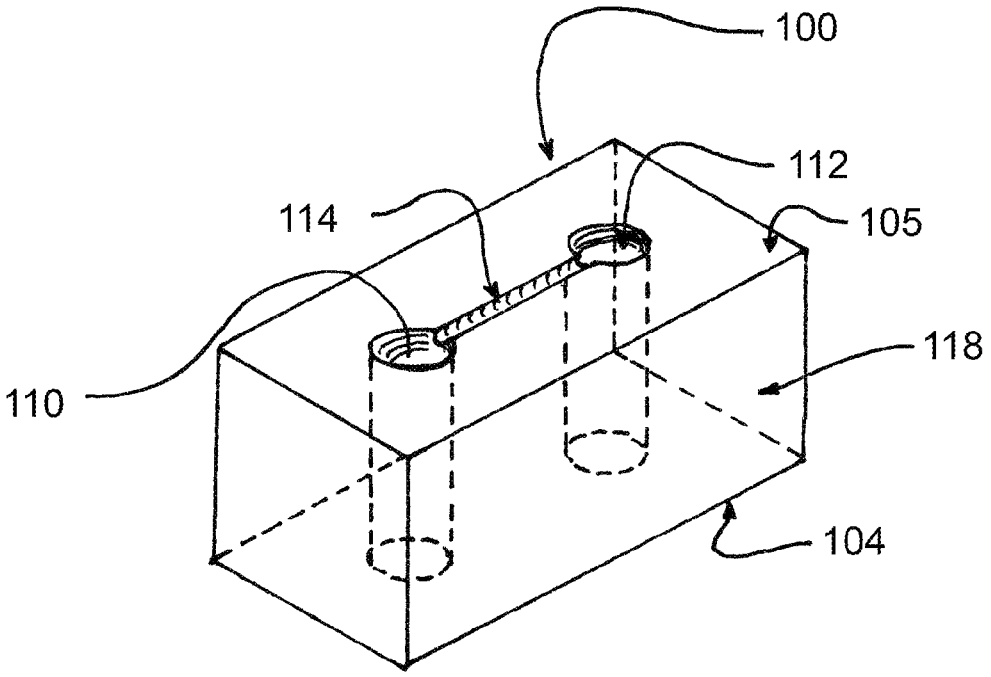
FIG. 2 is a bottom perspective view of building block formed from the extrusion produced block of FIG. 1.

With reference to FIG. 2, the first configuration derived from the building block 100 is presented in detail. To create the building block 100, the alterations made to the building block 100 are performed with commonly available wood working tools and require no specialized machining to achieve. As represented in FIG. 2, first and second hollows or bores, 110 and 112, respectively are formed through the building block 100 parallel to the extrusion axis 101 and may continue from the top surface 104 completely through to the bottom surface 105. Although the hollows are illustrated and described with reference to FIG. 2 as bores, it will be appreciated that other types of hollows, or depressions may also be utilized so as to provide a recessed portion within one or both of the top or bottom surfaces 104 and 105. The bores 110 and 112 may substantially cylindrical in shape, although it will be appreciated that other cross-sections, such as, by way of non-limiting example, square, triangular, star-shaped or irregular, and are designed to accommodate a pin therein, as will be further described below. The bores 110 and 112 may be machined into the building block 100 and may be selected to have a diameter between ¼ and 2 inches (6 and 51 mm) although it will be appreciated that other diameters may be useful as well.

Figure 3:
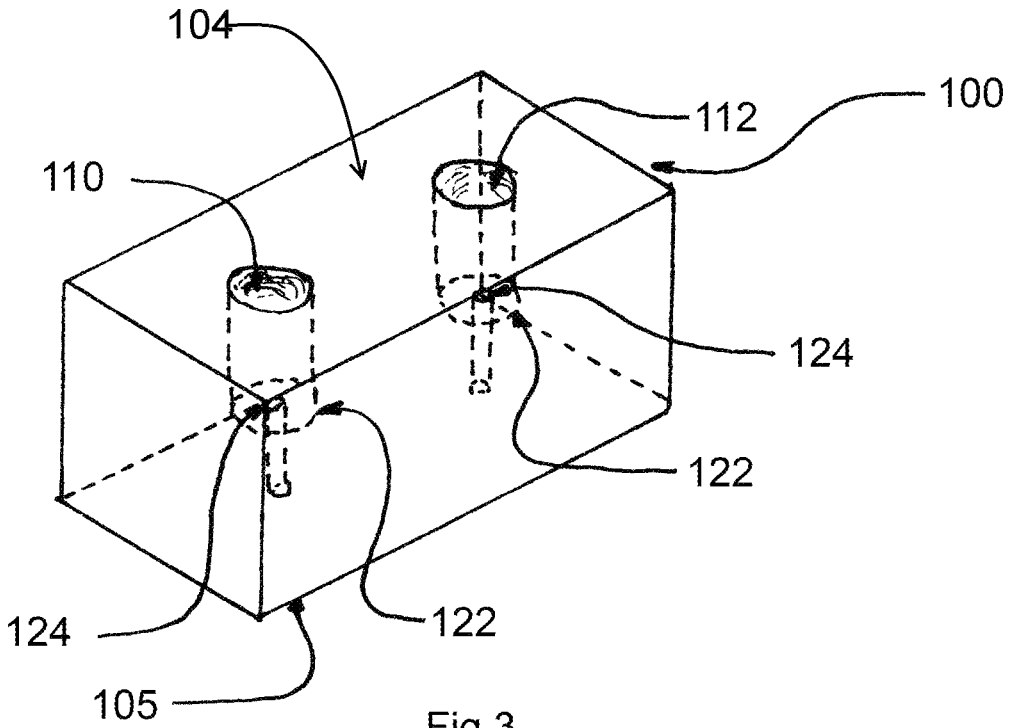
FIG. 3 is a top perspective view of a base block formed from the extrusion produced block of FIG. 1 according to a further embodiment of the present invention.
Figure 4:
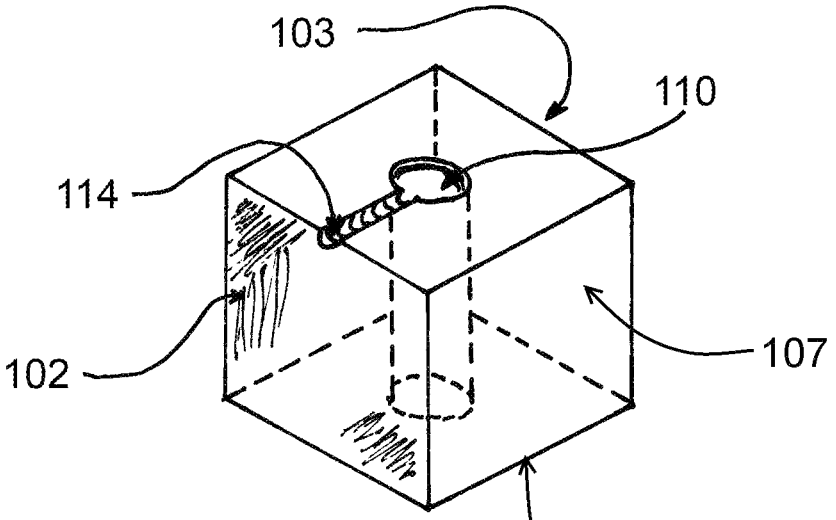
FIG. 4 is a bottom perspective view of a half block according to a further embodiment of the present invention.

To establish the location of both the bores 110 and 112, the length of top and bottom surfaces 104 and 105 are bisected (which equal the lengths of first and second sides 106 and 107) by bisecting line, generally indicated at 116. Once this has been done; two equally sized squares generally indicated at 118 and 120. Thereafter the bores 110 and 112 may be located in the center of the first and second squares 118 and 120 so as to space the bores 110 and 112 equal distance from the first and second sides 106 and 107 and one of the first and second ends 102 and 103. A groove or channel 114 may then be machined or otherwise formed in one of the top or bottom surfaces 104 and 105 of the building blocks between the bores 110 and 112, the purpose of which will be more fully described below. The channel 114 may be routed into surface using available wood working equipment and runs between the centre of each of the bores 110 and 112. The groove or channel 114 may have any suitable shape and profile as selected by a user, such as, semi-circular, notched, rectangular or irregular. The channel 114 is present to accommodate the elongate portion or member of a connecting key as will be more fully described below. The described channel may optionally have a width or radius approximately half that of the width or radius of the bores 110 and 112. Optionally, the channel may have a radius or depth which is slightly larger than the depth or width of the elongate portion of the connecting ties to accommodate any adhesive that may become present at assembly as will be more fully described below. As shown in FIGS. 2 through 4, the placement of the channel 114 and bores 110 and 112 ensures there are no voids in any of the exterior surfaces of the a wall formed using the building blocks as described above. The importance of this feature in the design of the building blocks 100 will become evident further along in this description.

Figure 5:
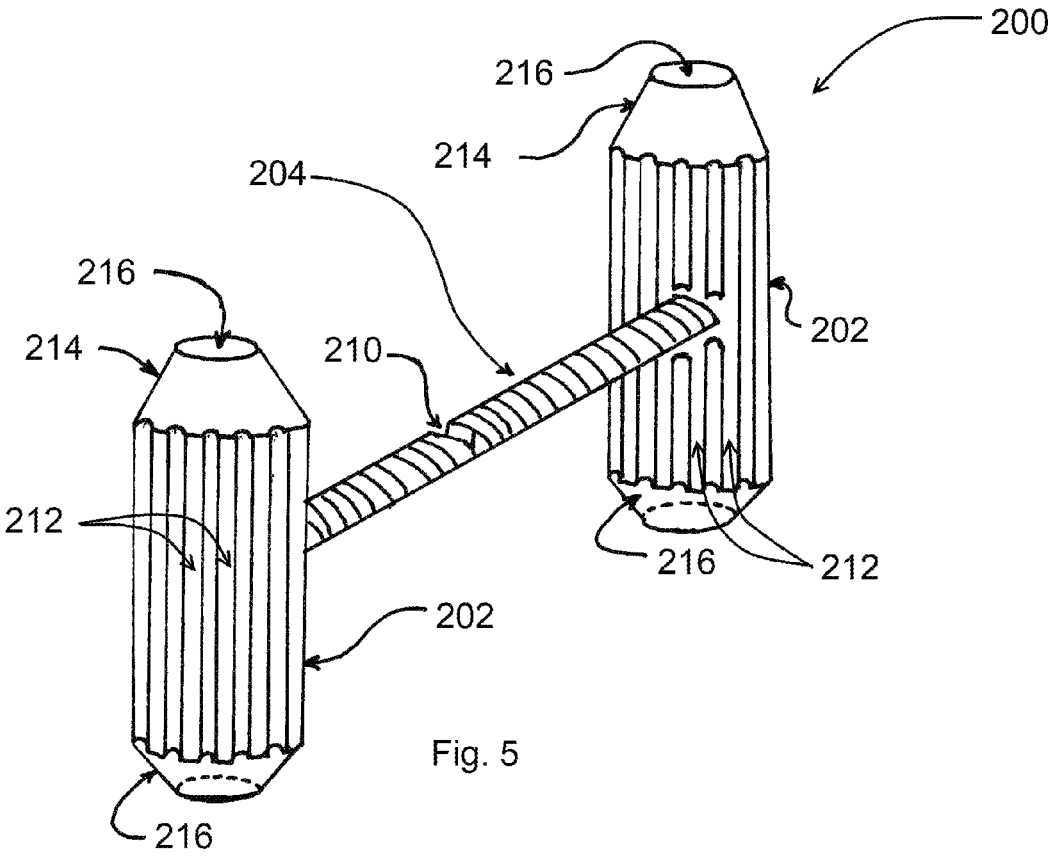
FIG. 5 top perspective view of a connecting tie according to a further embodiment of the present invention.
Figure 6:
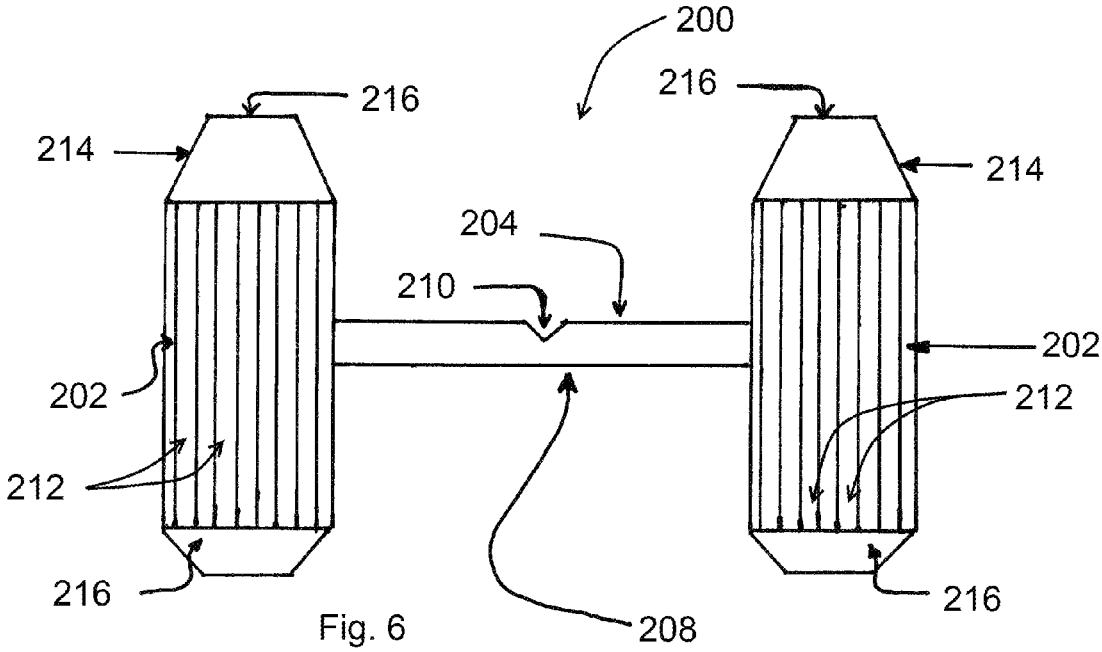
FIG. 6 is a side profile view of the connecting tie of FIG. 5.

With reference to FIGS. 5 and 6, a connecting tie 200 is illustrated which may be utilized for connecting adjacent and stacked building blocks 100 together. The function of this device is to connect or lock the various embodiments of the blocks described herein together into a structurally sound wall construction system. The connecting tie 200 locks the blocks together both vertically and horizontally. As can be seen in FIGS. 5 and 6, the connecting tie 200 incorporates two spaced apart enlarged portions or pins 202 connected to opposed distal ends of a central elongate member 204. The pins 202 are illustrated as substantially cylindrical, it will be appreciated that other cross-sections may be useful as well, such as, by way of non-limiting example, square, triangular, crossed, octagonal star shaped or irregular. The circumference of the pins 202 is selected to correspond to the diameter of the bores 110 and 112 machined into the building blocks 100 as set out above. Optionally, the circumference of the pins 202 is selected to be slightly smaller than the circumference of the bores so as to produce an interference or compression fit therebetween. The pins 202 are substantially similar to each other.

Figure 10:
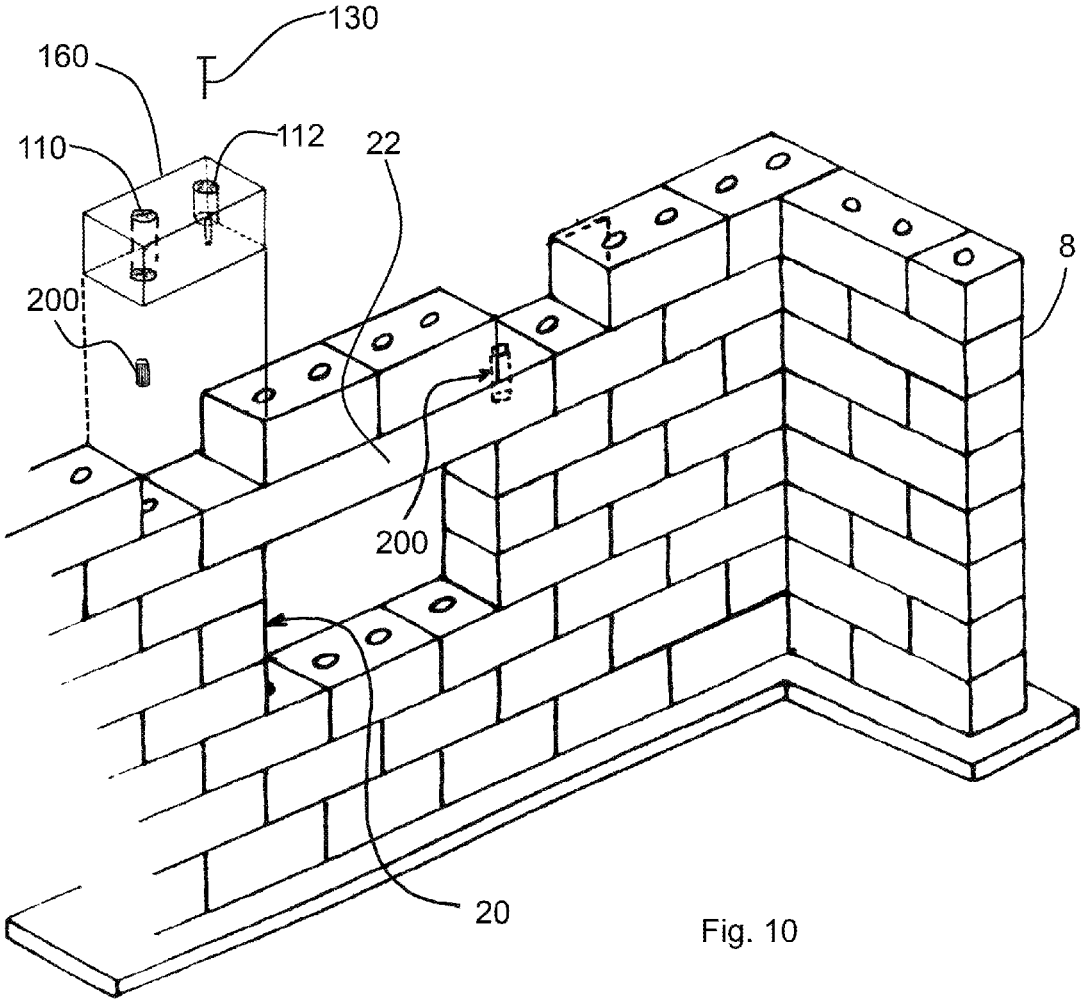
FIG. 10 is a perspective view of building blocks being located over a wall opening.

The elongate member 204 as shown in FIGS. 5 and 6 has top and bottom surfaces, 206 and 208, respectively and is connected to the pins 202 proximate to the a vertical midpoint of the pins 202. The top surface 206 may be profiled to correspond to the channel 114 while the bottom surface is substantially flat such that a bottom surface 208 of an elongate member 204 will lie substantially flat with a bottom surface 105 of a building block when the elongate member 204 is located within a channel 114 thereof. The cylindrical top surface of the elongate member 204 is designed to be easily accommodated by the channels machined into the previously described blocks and may optionally be slightly smaller than the channel 113 and may also correspond to the profile of the channel 114. Optionally, the elongate member 204 may be connected to each pin 202 such that the bottom surface 208 of the elongate member is located at the midpoint of each pin. Each elongate member 204 incorporates a notch 210 on the top surface that is centered along the length of the elongate member 204. This notch 210 is designed to allow the connecting tie 200 to be easily and accurately cut or bisected when required to install a half block as illustrated in FIG. 10.

As shown in the perspective drawing FIGS. 5 and 6, each pin may be molded with elongated grooves 212. These grooves serve to make installation into the blocks easier by reducing surface tension during installation and also allow the accommodation of adhesives between the pin 202 and the walls of the holes machines in blocks as described previously. Each pin 202 may have an angled or chamfered top and bottom 214 and 216, respectively to facilitate ease of installation. The lower chamfer 216 is designed to allow the installer to easily place the pin in the bores 110 and 112 prior to driving them into place. The pin 202 will proceed into the block up until the bottom surface of the connecting elongate member 204 comes into flush and firm contact with the top surface 104 of the building block 100. The top portion of the pins 202 of the connecting tie 200 may have a longer and more extreme chamfer 214 than that of the bottom 216 and may optionally have a flat or round end 216. The circumference of end 216 end is smaller than the circumference of the pin 202 itself, and is designed to ease fitting of each subsequent course of block onto the blocks already placed with pins installed as will be more fully described below and allow the blocks to be locked together top to bottom (vertically). This smaller flat surface is designed to give the installer a flat, firm and regular surface to allow them to drive the pins 202 into the blocks to lock them together from end to end (horizontally).

The connecting tie 200 as described herein is made of any known plastic and may be manufactured through injection molding by way of non-limiting example.

Figure 7:
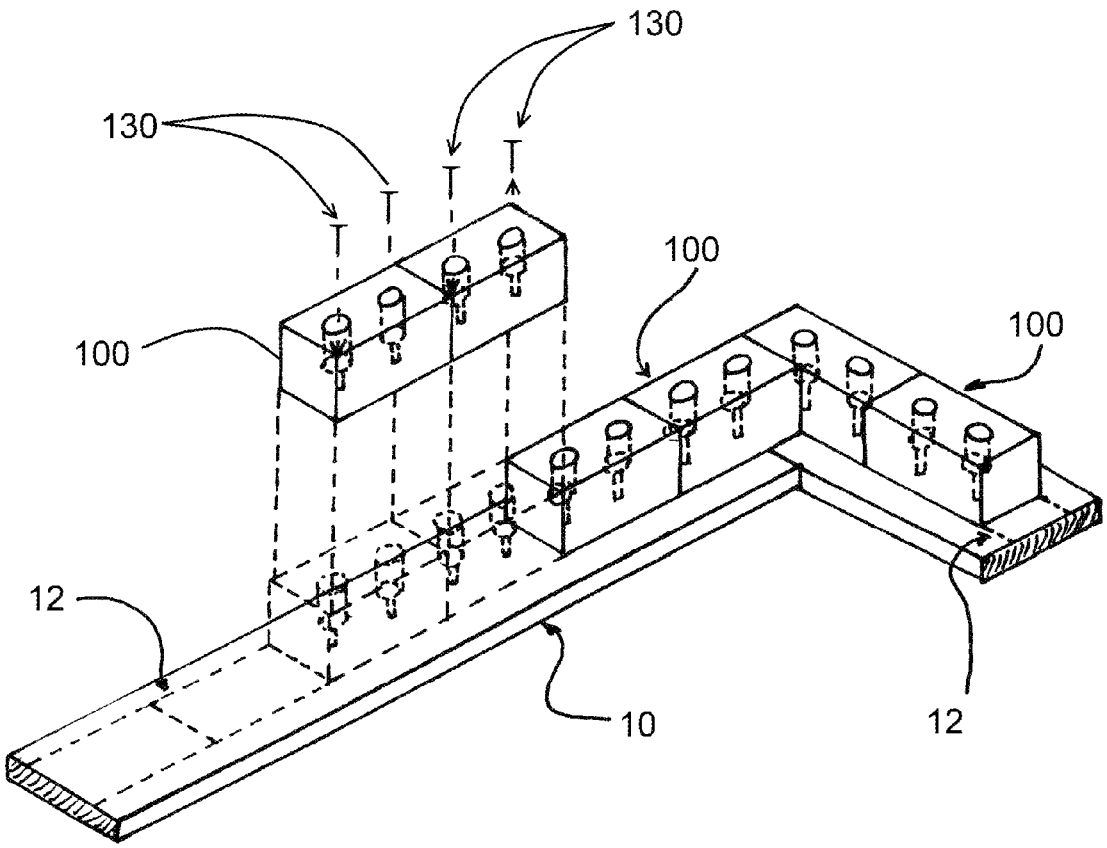
FIG. 7 is a perspective view of a plurality of a base layer of building b blocks being fastened to a base plate anchor during to a method of forming a wall according to a first embodiment of the present invention.

As illustrated in FIG. 2, the bores 110 and 112 may be machined completely through the building block 100 penetrating through both top and bottom surfaces 104 an d105. Optionally, the bores may extend from one of the top or bottom surfaces 104 and 105 only and terminate in a bottom 122 as illustrated in FIG. 3. Optionally, the building blocks 100 may also include a fastener bores 124 extending from the bottoms 122 of the bores 110 and 112 to the other of the top or bottom surfaces 104 and 105. The fastener bore 124 may have a diameter smaller than the first and second bores 110 and 112, such as between ⅛ and ½ inches (3 and 12 mm) by way of non-limiting example so as to receive a fastener (as illustrated in FIG. 7) therethrough. The fastener bores 124 may be concentric with or offset from an axis of the bores 110 and 112. Where the building block includes a fastener bore 124 extending from the bores 110 and 112, the building block may be referred to as a base block, the purpose of which will be more fully described below. In particular, in such embodiments, the bores 110 and 112, may penetrate the building block 100 slightly more than half of the height of the building block 100. This parameter is required to accommodate the pin 202 of the connecting tie 200 during assembly of the wall system described herein.

The circumference of the fastener bores 124 will accommodate elongated fasteners 130 as illustrated in FIG. 7 that will mechanically attach the building blocks 100 to another structure. The circumference of the fastener bores 124 will be small enough to allow the head of the fastener 130 to rest upon the base of the bores 110 and 112. As illustrated in FIG. 7; when installed in this way, the building blocks 100 will be firmly connected to the structure and form a permanent mechanically attached foundation for the construction of the balance of the wall system herein described.

With reference to FIG. 4, another embodiment of the building block 100 is illustrated in which the building block 100 may be cut or otherwise reduced in length such that the first end 102 corresponds to the bisecting line 116 of the building block 100 as set out above. Such an embodiment be referred to as a half block 150 which may be useful for terminating a layer of building blocks where the building blocks are stacked with a 50% offset for each successive layer as is commonly understood. It will be observed that such half block 150 includes only one bore 112 and a channel 114 extending to the first end 102 thereof. It will be appreciated that as the first end may be manufactured by bisecting or cutting the building block 100 in half along the extrusion axis 101 vertically from surface 206 through 207, such an end will be a non-factory finished surface. Accordingly during installation as described below, the first end 102 may be oriented internal to the wall so as to reduce exposure to and possible entrainment of moisture and water into the building block 100. The faces of the building block 100 will desirably present the most consistent and predictable surfaces while the machined/cut surfaces may remain internal to the finished wall system ensuring maximum wall system and surface integrity.

Optionally, the building block may include partial bores 110 and 112 as illustrated in FIG. 3 into the bottom surface 105 of the building block with a channel 114 extending therebetween so as to be useful in forming a topmost layer of the wall. Such partial bores 110 and 112 may omit the fastener bores 124.

The required components for construction of the wall system described herein have been discussed above, and it is now necessary to describe how these components integrate into a viable, efficient and structurally superior building system. The process of constructing the wall system commences in the same way as a conventional wood frame wall is constructed. Water proof adhesives as are commonly known may be applied during each step of assembly between blocks 100 and connecting tie 200. The chosen adhesive will provide the required adhesion during assembly of the wall system, and can be used to assemble all components required (including the plastic connecting tie 200 and the Rigid EPS Foam Insulation 1701) without negative impacts to the differing surfaces or need to utilize multiple adhesives to attach various different materials.

Figure 11:
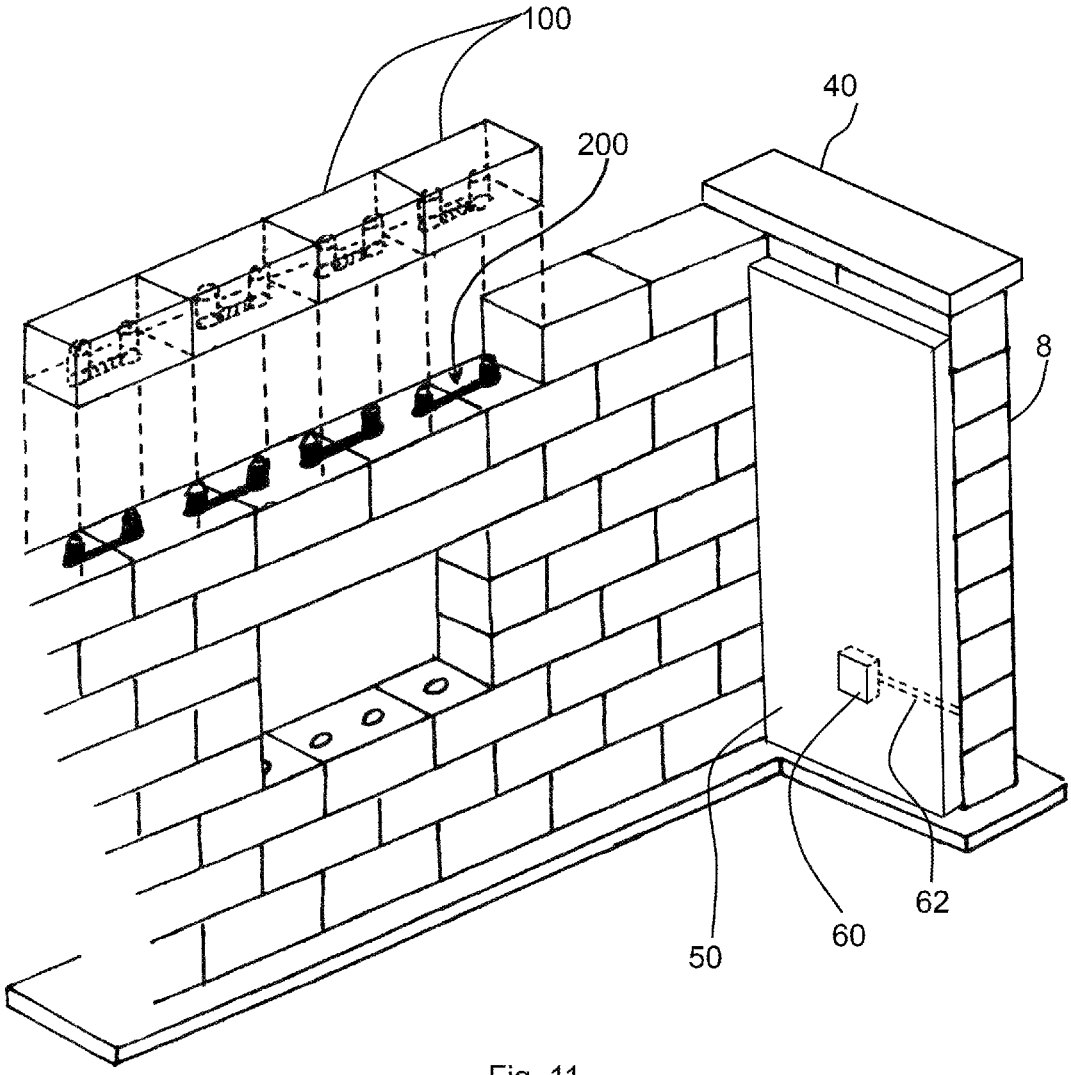
FIG. 11 is a perspective view of a top layer of building blocks or crown blocks being applied to a wall.

As shown in FIG. 7, the first step is to place and attached a base plate 10 which anchors the wall to the floor system and delineates the perimeter of the building being constructed. Thereafter, a chalk lines 12 may be created along the base plate 10 according to known methods to provide a guide to a worker as to the appropriate locations to place the first layer of building blocks. The base plate 10 may be wider than the building blocks 100 to allow for placement of the a wall finishing, such as rigid IPS foam insulation as is commonly known and as illustrated in as indicated in FIG. 11. Once located in the appropriate space, each building block 100 may be secured to the base plate 10 with fasteners 130 which are passed through the fastener bores 124 of each bore 110 or 112 and secured into the base plate 10. Such fasteners may comprise nails screws or the like. As illustrated in FIG. 7 each building block should be located proximate to an adjacent building block such that the first end 102 of one block is in direct contact with the second end 103 of an adjacent block. At corners, the first or second end 102 of one building block 100 may be abutted against the first or second side 106 or 107 of the adjacent block. Optionally adhesives may also be applied between the blocks and/or the base plate.

Figure 8:
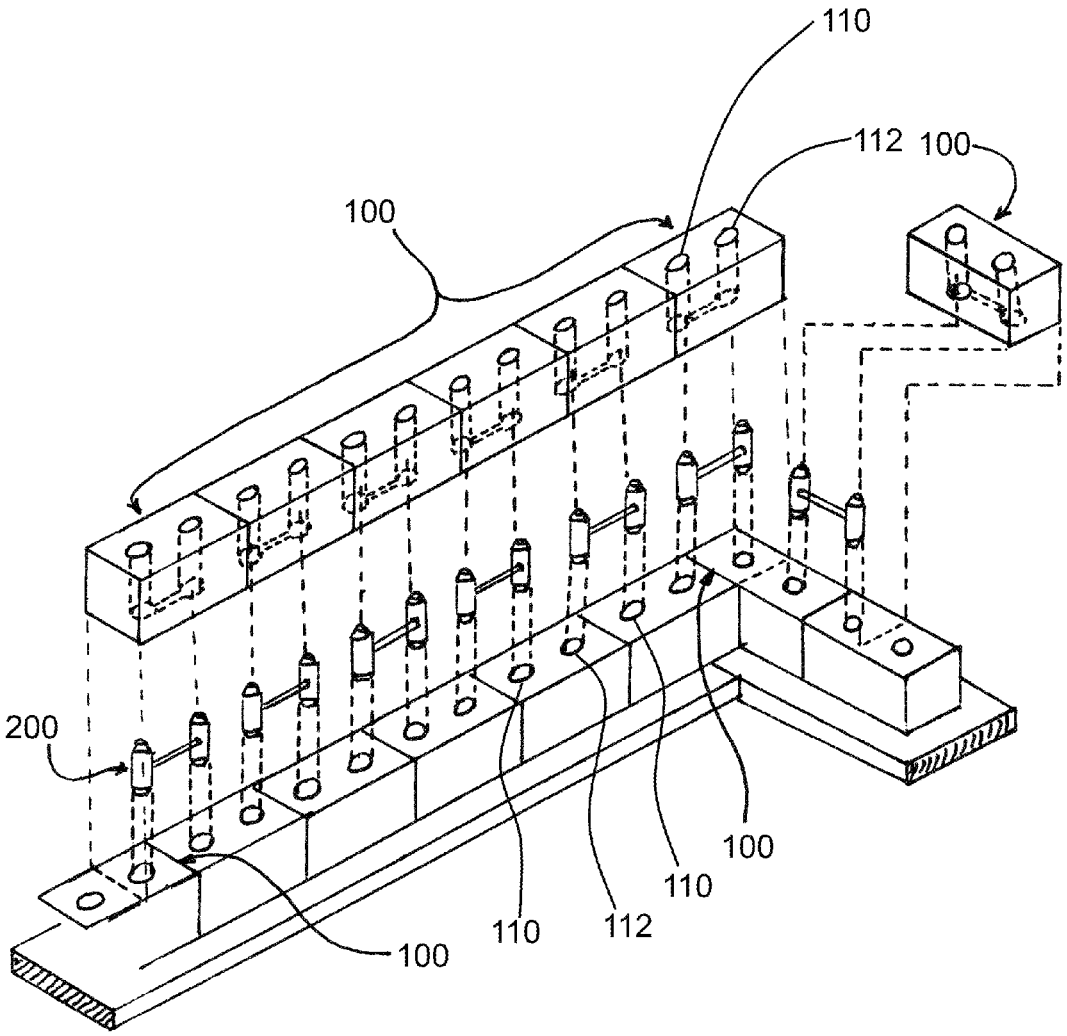
FIG. 8 is a perspective view of successive layers of building blocks and connecting ties being applied to each other to form a wall.
Figure 9:
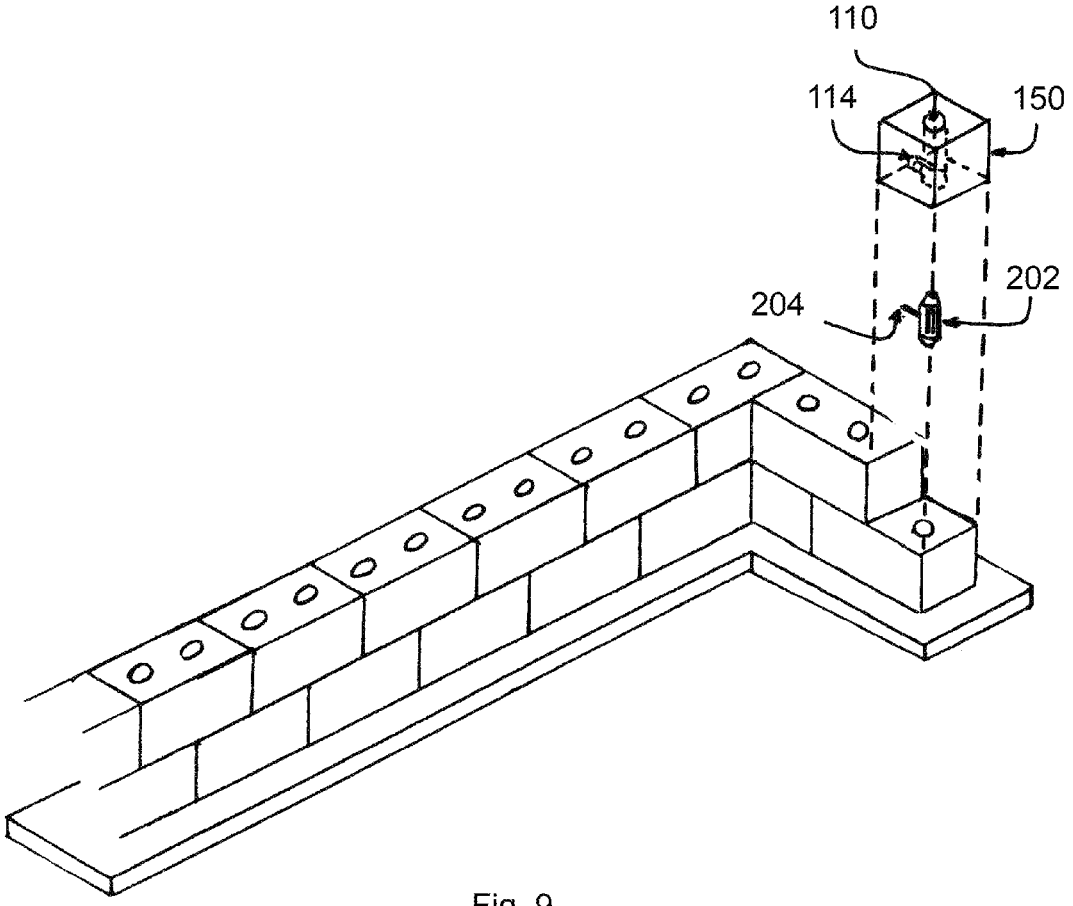
FIG. 9 is a perspective view of a half block being applied to a wall for form and end surface thereof.

With reference to FIG. 8, connecting ties may be located within the bores 110 and 112 so as to span a pair of adjacent building blocks. Thereafter, a further layer of building blocks may be located on the first layer so as to receive the pins 202 within the bores 110 and 112 of the second layer of blocks. Successive layers may be built in a like manner. As shown in FIG. 8, the building blocks 100 are connected together in a direction that would represent a larger portion of a constructed wall assembly. The blocks are aligned from end to end as they would be during the construction phase of erecting a block or brick wall system. The connecting tie 200 is installed and penetrates the blocks until the elongate member 204 comes into contact with the top surface of each block 100. The bottom surface of the elongate member 204 ensures a positive and level vertical alignment, where the elongate member itself ensures both building blocks are firmly connected and squarely aligned horizontally. As can be seen in FIG. 8, the top surface 206 of the elongate member 204 will be received within the channel of the second row of building blocks. With reference to FIG. 9, a half block 150 may be utilized at the end of every second layer so as to provide an even finished end to the wall. It will be observed that a connecting tie 200 may be severed at the notch 210 so as to be located between the half block 150 and the preceding and successive layers of building blocks. One aspect of the present wall construction system is its ability to be vertically and horizontally locked together. All facing surfaces; both interior and exterior, maintain the integrity achieved when manufactured without intrusion or penetration points, and this is made possible by all connections remaining internal to the finished wall system.

With reference to FIG. 10, a window door or other opening 20 may be formed in the wall by providing a break in several layers of building blocks as set out above. At the top edge of the opening 20, a structural beam 22 or lintel may be provided to span this opening as is commonly known. The lintel may have a height corresponding to one or more layers of building blocks 100. After being located to span the opening, the remainder of the layers of building blocks may be continued. Thereafter, the building blocks 100 may be located thereover by providing building blocks having fastener bores 124 on one or both of the bores 110 or 112 may be secured over the lintel and fasteners 130 passed therethrough to secure the building blocks 100 to the lintel. Optionally, the lintel 22 may be bored or otherwise drilled at a location so as to correspond to a pin 202 so as to permit a full size connecting tie 200 to be utilized.

With reference to FIG. 11, at the top of the wall, building blocks having blind bores 110 and 112 extending into the bottom surface 105 only, which may be referred to as crown blocks, may be located over the topmost connector tie 200 such that the pins are received therein as previously described. Such blind bores may will leave no exposed opening to the top edge of the wall to as to prevent the inclusion of water, debris and the like. Optionally a top plate 40 may be secured thereover by fasteners, adhesives or the like. Furthermore, after constructing a wall as set out above, wall cladding materials 50, such as, by way of non-limiting example, rigid foam insulation, plywood, gypsum board and the like. Optionally, the base plate 10 and top plate 40 may be wider than the building blocks 100 to extend past the cladding material 50. Additionally, the use of rigid foam insulation permits electrical services such as wiring 62 and junction boxes 60 to be embedded and installed therein.

While specific embodiments of the invention have been described and illustrated, such embodiments should be considered illustrative of the invention only and not as limiting the invention as construed in accordance with the accompanying claims.

What is claimed is:

1. A kit for forming a wall comprising:

a first plurality of substantially cuboid shaped building blocks each having a continuous solid uniform height exterior vertical surface adapted to be closely stacked with a second plurality of corresponding adjacent blocks, said first plurality of building blocks each having a pair of parallel spaced apart bores extending therethrough between top and bottom surfaces thereof, wherein each bore of said pair of bores is spaced equidistance from each of an end surface and opposed side surfaces of one of said first plurality of building blocks and are spaced and located apart by a distance equal to a width of one of said first plurality of building blocks, a plurality of connecting ties, each connecting tie extending between first and second ends, each said connecting tie having spaced apart enlarged portions comprising solid unitary cylindrical members having a continuous profile extending therealong at each end thereof with an elongate member extending between said cylindrical members having a height substantially less than said first plurality of building blocks, wherein said cylindrical members are sized to be frictionally received within said bores with an interference fit so as to span and retain a pair of said second plurality of adjacent building blocks together, and wherein each building block of said first plurality of building blocks includes a channel extending between said bores of the same building block, said channel being sized and shaped to receive said elongate member of said connecting tie therein when said cylindrical members are located in said bores.

2. The kit of claim 1 wherein each said channel is sized and shaped to receive said elongate member of said connecting tie spanning a pair of connected building blocks therein when one of said first plurality of building blocks is laid thereover and spanning said pair of connected building blocks.

3. The kit of claim 1 wherein each of said elongate members includes a frangible portion at a midpoint thereof.

4. The kit of claim 1 wherein said enlarged portions comprise pins.

5. The kit of claim 4 wherein said pins correspond in size and shape to the bores extending through said first plurality of building blocks.

6. The kit of claim 4 wherein each of said elongate members is connected to a midpoint of said pins.

7. A method for constructing a wall comprising:

providing a first plurality of substantially cuboid shaped building blocks each having a continuous solid uniform height exterior vertical surface adapted to be closely stacked with a second plurality of corresponding adjacent blocks, said first plurality of building blocks each having a pair of parallel spaced apart bores extending therethrough between top and bottom surfaces thereof, wherein each bore of said pair of bores is spaced equidistance from each of an end surface and opposed side surfaces of one of said first plurality of building blocks and are spaced apart by a distance equal to a width of one of said first plurality of building blocks, providing a plurality of connecting ties, each connecting tie extending between first and second ends, each said connecting tie having spaced apart enlarged portions comprising solid unitary cylindrical members having a continuous profile extending therealong at each end thereof with an elongate member extending between said cylindrical members having a height substantially less than said first plurality of building blocks, wherein said cylindrical members are sized to be frictionally received within said bores with an interference fit so as to span and retain a pair of said second plurality of adjacent building blocks together, wherein each building block of said first plurality of building blocks includes a channel extending between said bores of the same block, said channel being sized and shaped to receive said elongate member of said connecting tie therein when said cylindrical members are located in said bores, locating a first building block of said first plurality of building blocks on a ground surface, locating a second building block of said first plurality of building blocks adjacent to said first building block, frictionally locating a first of said solid unitary cylindrical members of one said connecting tie by said interference fit within a first said bore in a horizontal surface of said first building block and frictionally locating a second of said solid unitary cylindrical members of the one connecting tie by said interference fit within a second said bore in a horizontal surface of said second building block so as to operably couple said first and second building blocks together, and frictionally locating a third building block of said first plurality of building blocks in staggered relation to said first and second building blocks on said one connecting tie so as to receive said first and second cylindrical members by said interference fit within corresponding first and second bores of said third building block such that said elongate member of said one connecting tie is located within said channel of said third building block.

* * * * *